US006435353B2

(12) United States Patent
Ryan, Jr. et al.

(10) Patent No.: US 6,435,353 B2
(45) **Date of Patent: *Aug. 20, 2002**

(54) STORAGE RACK FOR STORING SORTED MAILPIECES

(75) Inventors: William E. Ryan, Jr., Monroe; Kenneth A. Schulz, Bethel; Lyle W. Shaw, Southbury; John H. Steinmetz, Bridgeport, all of CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/922,031

(22) Filed: Aug. 3, 2001

Related U.S. Application Data

(63) Continuation of application No. 09/460,150, filed on Dec. 13, 1999, now Pat. No. 6,347,710.

(51) Int. Cl.[7] ..... B07C 5/00; B42F 17/00; A47F 1/04

(52) U.S. Cl. ..... 209/706; 209/900; 211/59.2; 211/90.2

(58) Field of Search ..... 209/703, 704, 209/706, 707, 900, 911; 211/59.2, 90.2, 107

(56) References Cited

U.S. PATENT DOCUMENTS 2,013,284 A * 9/1935 Michaud ..... 211/59.2
2,176,384 A * 10/1939 Varney ..... 211/59.2
2,742,161 A * 4/1956 Nuttall ..... 209/703
3,685,876 A * 8/1972 Dietrich ..... 308/37
3,871,524 A * 3/1975 Helf ..... 211/45
5,115,920 A * 5/1992 Tipton et al. ..... 211/59.2
D382,140 S * 8/1997 Loflin ..... D6/465
5,816,419 A * 10/1998 Lamson ..... 211/150
5,944,201 A * 8/1999 Babboni et al. ..... 211/151
6,073,786 A * 6/2000 McCorkle, Jr. ..... 211/187

* cited by examiner

*Primary Examiner*—Donald P. Walsh
*Assistant Examiner*—Joseph Rodriguez
(74) *Attorney, Agent, or Firm*—Alberta A. Vitale; Charles R. Malandra, Jr.; Angelo N. Chaclas

(57) ABSTRACT

This invention overcomes the disadvantages of the prior art by providing an apparatus that will assist in sorting mailpieces which increases the efficiency of the mail sorting apparatus, provides an organized space for intermediate storage of mailpieces and provides ergonomic features that reduce injury to the mail sorting apparatus operator and increases productivity. The present invention is directed to, in a general aspect, a mailpiece storage rack. The storage rack is used to hold partially sorted mailpieces between sorting passes in multiple pass sorting of mailpieces using a mail sorting apparatus or stores mailpieces after sortation and prior to delivery. The storage rack maintains the grouping, sequence and stack quality or alignment of partially sorted mailpieces which provides for more efficient refeeding. The rack is designed ergonomically for easy transferring of mail into and out of storage and also provides for organized workflow. The storage rack may be configured to accept containers such as, for example, standard tubs used by national posts, and/or custom tubs designed for mailer environments.

10 Claims, 5 Drawing Sheets

STORAGE RACK FOR STORING SORTED MAILPIECES

This is a continuation of Application No. 09/460,150, now U.S. Pat. No. 6,347,710, filed Dec. 13, 1999 .

FIELD OF THE INVENTION

The invention disclosed herein relates generally to automated mail sorting and, more particularly to a storage rack for providing storage for mail pieces between sorts or prior to delivery.

BACKGROUND OF THE INVENTION

The processing and handling of mailpieces consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be addressed, collected, sorted, and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

Mailpiece sorting can be performed manually or with automated equipment designed specifically to perform the sorting task. Manual sorting is labor intensive and time consuming and has historically been done using pigeon hole type sorting stations. Modern automated mailpiece sorting equipment typically comprises a feeding mechanism for feeding mailpieces, a separating mechanism for separating the mailpieces, a reading means for reading the information on the mailpieces, a mailpiece transport mechanism for transporting the mailpieces to compartments or bins, bins for receiving the mailpieces, software for making choices regarding placement of mailpieces into the compartments and a control system.

Mailpieces may require multiple sortations, each sortation using a different sort scheme (i.e. sort by state, by zip code, by mail stop etc.). For example, outgoing mail may be sorted "by state" on a first sort and each state group is sorted "by zip code" on the next sort. Between sorts, the mailpieces need to be stored in a manner that does not disrupt the order and grouping of the mailpieces. That is, it is preferable to keep the mailpieces edge aligned and in their sort groups between sorts. Similarly, for incoming mail, mailpieces may be sorted several times. For example, incoming mail to a multiple story building may be sorted "by floor" on the first sort and then each floor group is sorted "by destination point code" or mailstop on the next sort. As with the outgoing mail, between sorts, the mailpieces need to be stored in a manner that does not disrupt the order and grouping of the mailpieces. A table or a storage rack may be positioned adjacent to the mail sorting equipment for storing mailpieces between sorts or prior to delivery. However, the configuration of the storage area could disrupt the grouping of the mail and cause processing delays.

The operation of automated sorting equipment typically entails an operator placing an armload or handful of mail that has been edge aligned onto the feeding mechanism of the apparatus. The mailpieces are fed into the sorting apparatus and sorted into bins. Typically, when one or more bins become full, the sorting apparatus stops and the bins are manually emptied into a mail container by an operator. Alternately, the sorting apparatus may provide a signal to the operator to empty a full or almost full bin while the mail sorting apparatus is sorting. Storage racks may be provided for the temporary storage of mailpieces in mail containers. The storage racks are used to store the mailpieces in an organized fashion between sorts. However, during storage, the mailpiece edge alignment may become disrupted due to the configuration of the storage rack.

The movement of the operator in emptying the bins and transferring the mailpieces to the storage racks can cause injuries, such as repetitive stress injuries, to the operator. Specifically, wrist injures can be caused by repetitive wrist twisting and back injuries can be caused by lifting mail containers and bending over to look into containers while placing mailpieces. Temporary storage racks have not provided the ergonomics or human factors that would allow the operator to perform the transfer comfortably, efficiently and safely. Ergonomic design would improve operator's interactions with such systems and reduce costs of running the system due to decreased lost time for injuries and improved worker performance.

Thus, one of the problems of the prior art is sorting systems may run less efficiently. Another problem of the prior art is that prior art configuration can decrease operator productivity. An additional problem of the prior art is that poor ergonomics may cause injury to the mail sorting system operator(s). Another problem of the prior art is that mailpieces may become disorganized during intermediate storage. A storage device is therefore needed that will overcome these problems.

SUMMARY OF THE INVENTION

This invention overcomes the disadvantages of the prior art by providing an apparatus that will assist in sorting mailpieces. The invention increases the efficiency of the mail sorting apparatus, provides an organized space for intermediate storage of mailpieces and provides ergonomic features that reduce injury to the mail sorting apparatus operator and increases productivity. The present invention is directed to, in a general aspect, a mailpiece storage rack. The storage rack is used to hold partially sorted mailpieces between sorting passes in multiple pass sorting of mailpieces using a mail sorting apparatus or stores mailpieces after sortation and prior to delivery. The storage rack maintains the grouping, sequence and stack quality or alignment of partially sorted mailpieces which provides for more efficient refeeding. The rack is designed ergonomically for easy transferring of mail into and out of storage and also provides for organized workflow. The storage rack may be configured to accept containers such as, for example, standard tubs used by national posts, and/or custom tubs designed for mailer environments. Preferably, two shelves are used for storage of mail containers and a third, lower most shelf is used for storage of empty mail containers, envelope boxes or other suitable items.

Thus an advantage of the apparatus of the present invention is that it provides ergonomic design. Another advantage of the present invention is that it allows for more efficient use of the mail sorting apparatus. Another advantage of the present invention is that it provides for maintaining grouping, sequence and stack quality or alignment of the mailpieces. Another advantage of the present invention is that it provides for efficient re-feeding of mailpieces. Other advantages of the invention will in part be obvious and will in part be apparent from the specification. The aforementioned advantages are illustrative of the advantages of the various embodiments of the present invention.

DETAILED DESCRIPTION OF THE PRESENT INVENTION

In describing the present invention, reference will be made herein to FIGS. 1–4 of the drawings in which like numerals refer to like features of the present invention.

Hardware Overview

Figure 1:
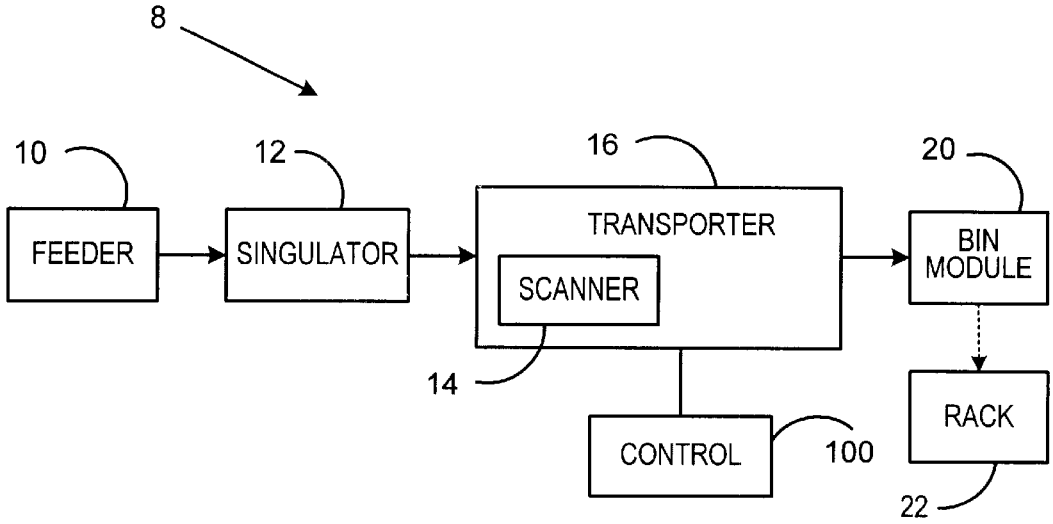
FIG. 1 s a block diagram of an embodiment of a mailpiece sorting apparatus and a storage rack.

A mailpiece sorting apparatus 8, illustrated in the block diagram of FIG. 1, may generally comprise a feeder 10, a singulating module 12, a scanner 14, a transport apparatus 16 for delivering the mailpieces to bin module 20, bins 18 (shown in FIG. 1*a*) positioned in bin module 20 for receiving sorted mailpieces and a control system 100. The control system 100 may be a microprocessor controller such as, for example a personal computer with a Pentium II™ microprocessor. The microprocessor can run an operating system such as a QNX operating system that provides real-time control of the components of the mailpiece sorting apparatus 8. The computer also includes appropriate memory devices for storage of information such as an addressee database. A sensor 23 in each bin 18 is for sensing when the bin 18 is partially-full to a particular percentage of the bin 18 height. The sensor 23 may be for example a photo electric sensor 23 for detection of light, which when blocked indicates the bin 18 is full to the height of the sensor 23. A light emitting diode on the outside of the bin 18 may be used to signal the operator that the bin 18 should be emptied.

The present invention is a storage rack 22 for the storage of mailpieces that have been sorted by the mail sorting apparatus 8 into bins 18. The mailpieces are removed from bins 18 and placed in containers 24 on the storage rack 22 while awaiting subsequent sorting or delivery to destination points.

Storage Rack

In the block diagram of FIG. 1, the bin module 20 of mailpiece sorting apparatus 8 is shown adjacent to an embodiment of the storage rack 22 of the present invention. The storage rack 22 is used for the intermediate storage of mailpieces after the mailpieces are removed from the bins 18 of bin module 20. The storage rack 22 preferably is made using a metal framework such as tubular steel. The mailpieces are placed in containers 24 on the storage rack 22. The mail containers 24 may be standard mail tubs used by national posts, or custom tubs designed for a mailer's environment.

Figure 1A:
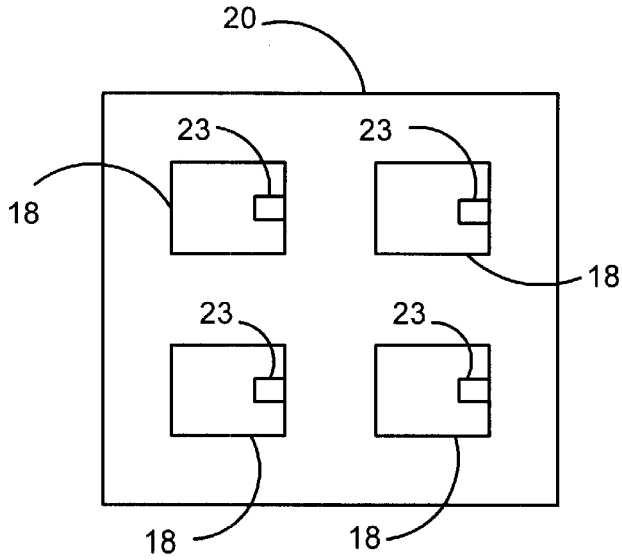
FIG. 1*a* is a block diagram illustrating a four bin module which may be part of the mailpiece sorting apparatus which is used to perform a method of the present invention.

FIG. 1*a* is a block diagram illustrating a four bin module 20 which may be part of the mailpiece sorting apparatus 8. The four bin 18 configuration and sensor 23 configuration is shown for illustration purposes; other suitable configurations may be used. The sensor 23 signals at the appropriate time when the bin 18 needs emptying and is preferably positioned so that the signal gives the operator sufficient time to react to the sensor 23 and empty the bin 18 onto the storage rack 22 before the bin 18 becomes completely full.

Figure 2:
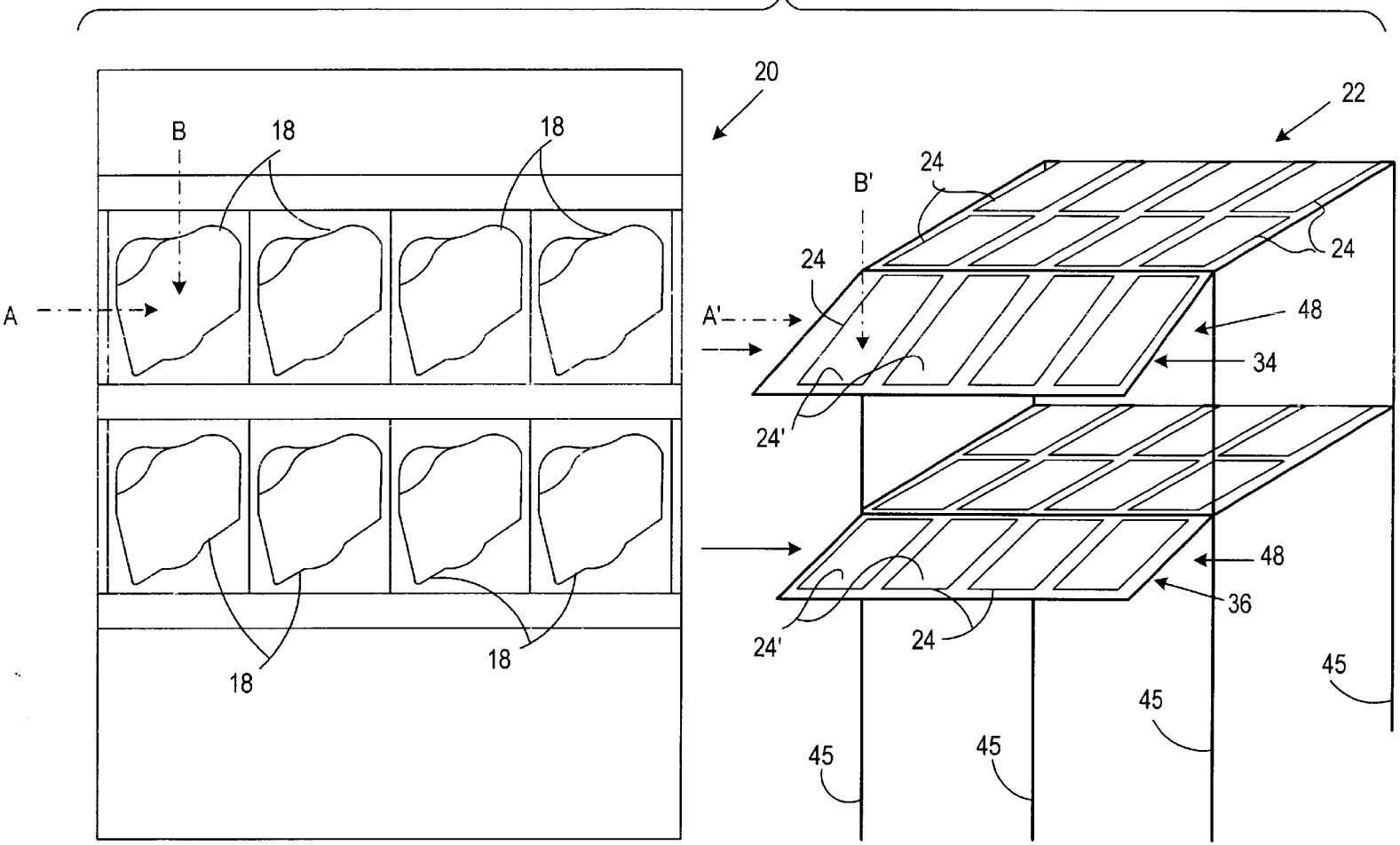
FIG. 2 is an illustration of the relationship between the bins and the storage rack with containers.

FIG. 2 is an illustration of an exemplary relationship between the bins 18 in bin module 20 and an embodiment of the storage rack 22 of the present invention with containers 24 resting on the storage rack 22. In order to facilitate the description of the relationship of the bins 18 and shelf columns, and bins 18 and shelf rows, the rows have been labeled A and A', respectively, and the columns have been labeled B and B', respectively. Preferably, the arrangement of the shelves of the storage rack 22 corresponds with the arrangement of the bins 18 in the bin module 20 in a manner such that the horizontal frequency of number of containers 24 that will fit on shelf A' per unit length of the storage rack 22 approximately equals the horizontal frequency of the number of bins 18 per row A in the bin module 20. Additionally, the vertical frequency of the number of shelves per column B' per unit length of the storage rack 22 approximately equals the vertical frequency of the number of bins 18 per column B in the bin module 20. The heights of the rows and the heights of the corresponding bins 18 preferably are similar.

For illustration purposes, the storage rack 22 of FIG. 2 is configured to accept mail from an eight bin module 20; however, other configurations for other bin modules appropriate for the mail sortation may be used. A single bin module 20 and single storage rack 22 are shown for illustration purposes; however, the sorting apparatus may have multiple bin modules (or multiple bin module with a large number of bins), in which case, a storage rack 22 would be positioned adjacent to each bin module 20. Alternatively, one storage rack 22 configured to accept mailpieces from multiple bin modules can be used. The preferred positioning of the storage rack 22 is facing the bin module 20, forming an aisle with the bin module 20, approximately 1.2 m in width which would provide working space for the operators and for mail carts (not shown).

Figure 3:
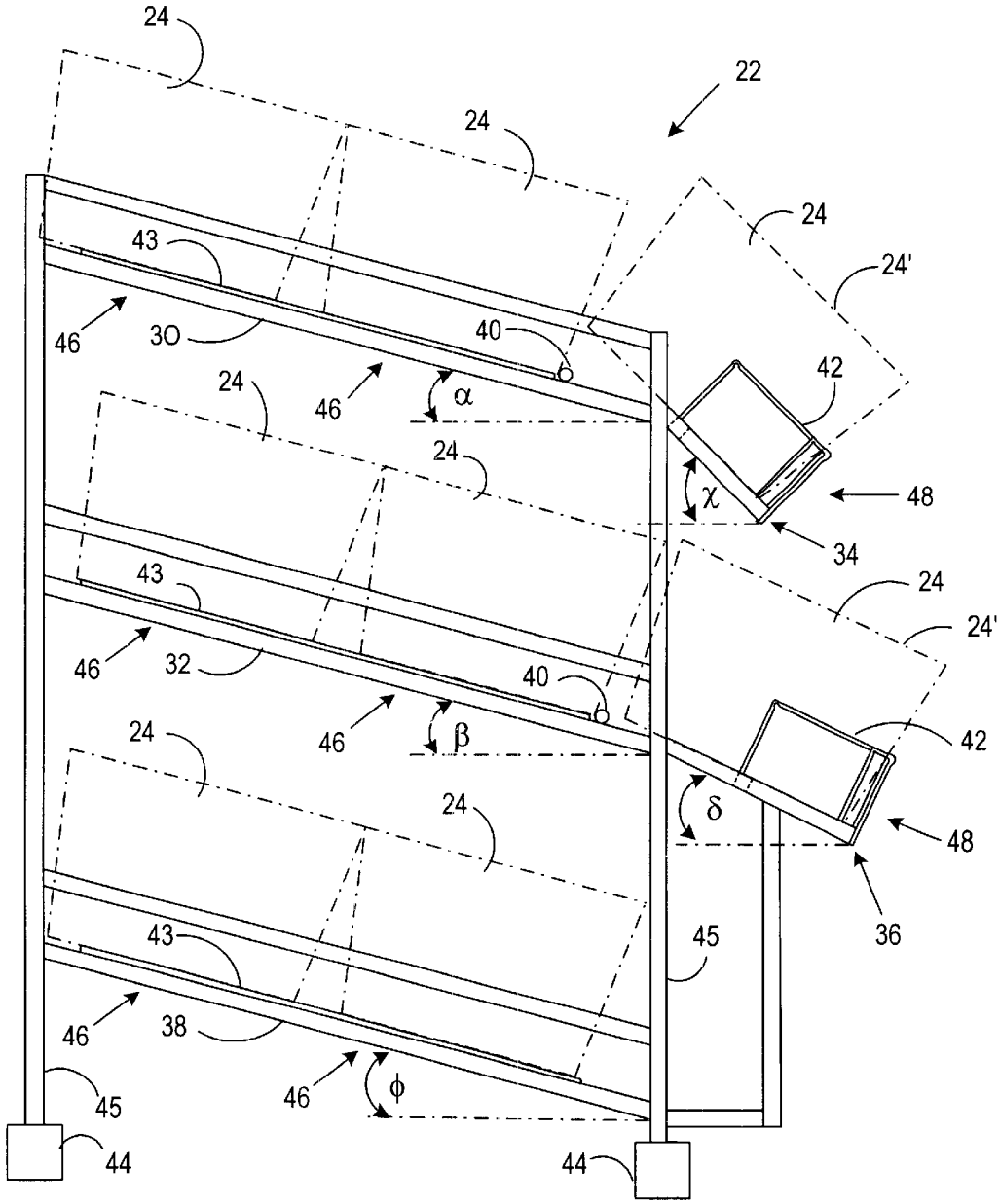
FIG. 3 is a side view of the an embodiment of the storage rack of the present invention.

FIG. 3 is a side view of the an embodiment of the storage rack 22 of the present invention. For illustration purposes, the storage rack 22 of FIG. 3 is configured to accept mail from the eight bin module 20. Preferably, upper and middle shelves 30, 32, respectively, are used for storage of mail containers 24 and a lower shelf 38 is used for storage of empty mail containers 24. The upper and middle shelves 30, 32 respectively, have extensions 34, 36 respectively, projecting forward and downward. Each extension is used to hold a mail container 24 in a working position 48. A bottom shelf 38 may be used for storage of empty containers 24. For ergonomics, in this embodiment, the upper shelf 30 may be positioned at an angle $\alpha$ between approximately 10 and 15 degrees to a horizontal axis. The preferred angle $\alpha$ for the upper shelf is approximately 13 degrees. Additionally, for ergonomics, in this embodiment, the middle shelf 32 may be positioned at an angle $\beta$ between approximately 10 and 15 degrees to a horizontal axis. The forward projecting extension 34 is positioned at an angle $\chi$ of approximately 50 degrees to a horizontal axis. The rests 42 are positioned so that container 24 when Positioned on the rests is resting at an angle $\Omega$ of less than 90 degrees to the front the rack and positioned preferably at an angle of about 75 degrees. The forward projecting extension 36 is positioned at an angle $\delta$ of approximately 50 degrees to a horizontal axis. The preferred angle $\phi$ of the lower shelf 38 is approximately 13 degrees to the horizontal axis. The height of the storage rack 22 is adjustable to allow the working heights to be optimized for containers 24 of various depths and operators of various heights. The adjustments may be made using adjustable feet 44 which may be added to the legs 45 of the storage rack 22. The storage rack 22 may also be on casters or the like to facilitate easy movement.

Figure 4:
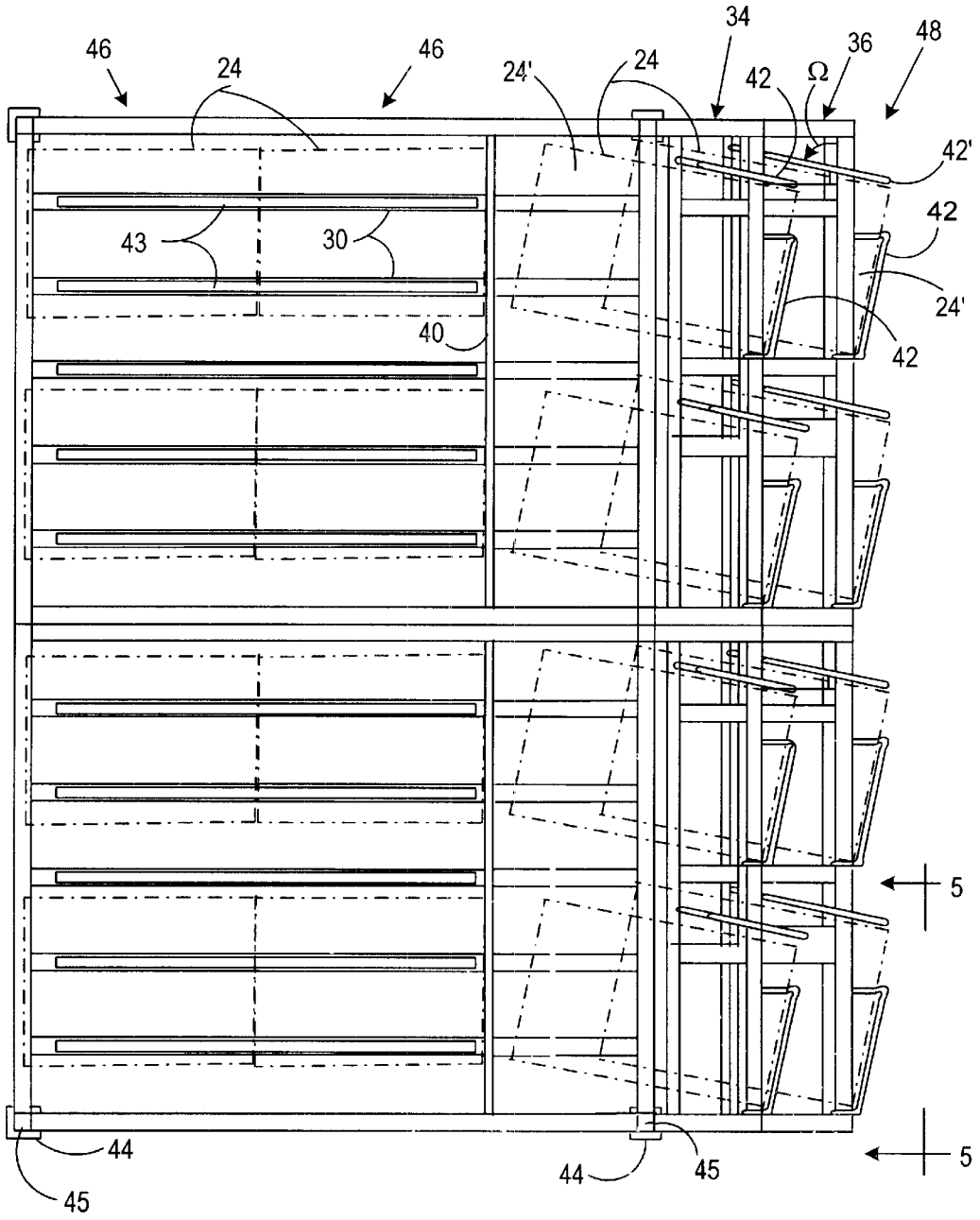
FIG. 4 is a top plan view illustrating an embodiment of the storage rack of the present invention in which the extensions are positioned at a compound angle.

The extensions 34, 36 each include at least one rest 42 for supporting a container 24 in a working position 48 (the working position 48 is the position in which a container is resting in an extension). Preferably, there are two rests 42 positioned on each of the extensions, 34, 36 and the rests 42 are positioned at an angle of 90 degrees to one another. The working position 48 is a compound angle of approximately 30 to 50 degrees to horizontal so that the open side of the container 24 is presented to the operator for easy loading of handfuls of mail removed from the appropriate bin by the operator. FIG. 4 is a top plan view illustrating an embodiment of the storage rack of the present invention in which the containers 24 are resting on the extension at a compound angle. The compound angle comprises the angle of the extension to the horizontal axis ($\chi$, $\delta$) and the angle $\Omega$ of rests 42' with respect to the front of the rack. The middle shelf extension 36 projects farther forward than the upper shelf extension 34, so that container openings 24' on the middle shelf extension 36 are not blocked by containers 24 in the working position 48 on the upper shelf extension 34. The angle $\chi$ is greater than the angle $\delta$; in this configuration, an operator can reach nearly straight into a container 24 on the upper extension 34 and can reach in a downward direction into a container 24 on the middle extension 36.

Figure 5:
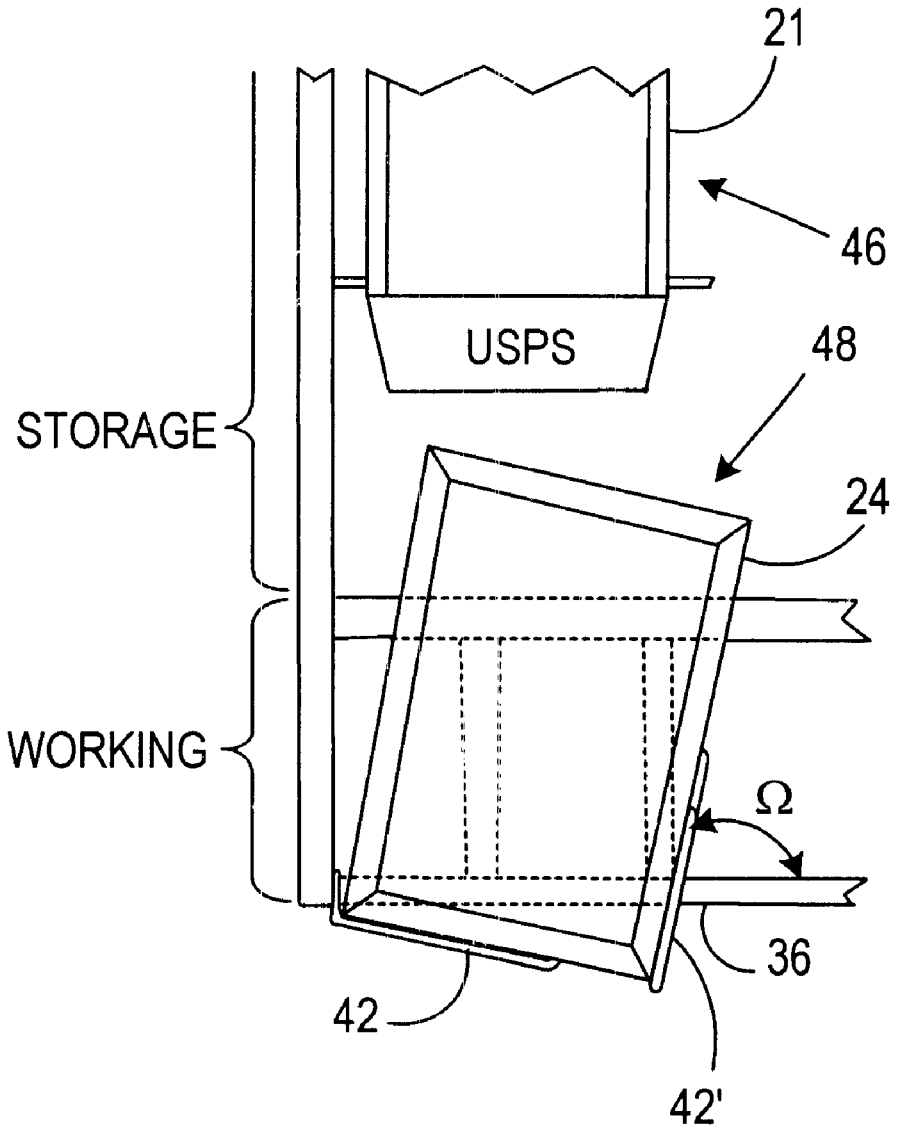
FIG. 5 is a partial front view of the storage rack of the present invention illustrating the extensions and rests shown in top plan view of FIG. 4.

FIG. 5 is a partial front view of the storage rack of the present invention illustrating the extensions and rests shown in top plan view of FIG. 4. The angle $\Omega$ is about 75 degrees with respect to the front of the rack.

At least a portion of the top of each of the angled shelves 30, 32, and 34 has an anti-friction treatment 43, such as acetal polymer resin sold under the tradename Delrin® and manufactured by DuPont, which has a high natural lubricity allowing containers 24 to slide up down the shelves 30, 32, 34 easily. The anti-friction treatment 43 may be applied with pressure-sensitive adhesive backing which adheres the treatment to the shelves 30, 32, 38. The anti-riction treatment 43 allows the operator to easily retrieve a container 24 from one of the shelves 30, 32, 34, as it will slide down within the operator's reach. The anti friction treatment 43 makes it easier for a full container to be pushed onto and stored on one of the shelves 30, 32. An alternative to the anti-friction treatment 43 is the use of bearing balls or rollers set into the shelves to provide a low friction surface for the containers 24 to slide on. At least one ridge 40 may be positioned on the upper and middle shelves 30, 32 at an end adjacent to the extensions 34, 36, to keep the forward most container 24 on each shelf from sliding forward and disrupting a container 24 resting on the extension. Preferably, the ridge 40 measures about ⅜ inch high and is rounded. The ⅜ inch height is large enough to provide stopping and small enough so as to not impede the operator from moving the container 24 from the shelf. Also, it is preferred that there be no ridge on the lower shelf 38 so that stored containers 24 may slide freely to the forward most position on the lower shelf 38 for easy access by the operator. Other suitable ridge heights may be used to achieve stopping, as well as the ability to move containers 24 over the ridge 40.

In use, empty containers 24 are placed on the extensions of the upper and middle shelves 34, 36 (in the working position 48) before or during a mail sortation, and mail is manually removed from the bins 18 as they fill or become almost full. When a container 24 is full, it is tipped up and slid from the working position 48 into a storage position 46 onto the upper portion of the shelf that is adjacent to the extension 34, 36 on which the container 24 sits. The containers 24 are stored in a First-In-Last-Out (FILO) arrangement. The columns with storage capacity for multiple containers provide for storage of many mailpieces removed from corresponding bins. Alternatively, the rack may be configured without the shelves and only with the extensions for holding mail containers at the compound angle.

The angled position of each of the containers 24 when resting on an extension improves the operator's line of sight into the container 24 and facilitates the correct placement of mail. The angle position helps to prevent mailpieces in a partially filled container 24 from toppling over and thus helps to preserve edge alignment and sequence of sorted mail which is helpful for subsequent sorting. The angle also reduces operator wrist rotation and thus reduces the risk of repetitive motion disorders. Additionally, the angle reduces the risk of misorientation of the mail. That is, when mailpieces are removed from sort bins 18, they are faced in the same direction and are placed in the containers 24 retaining their orientation for subsequent processing. In addition to the angle providing for better mailpiece storage, the configuration of the storage rack 22 in relationship to the adjacent bin module 20 provides for better sequencing of the stored sorted mailpieces. Thus, the storage rack 22 maintains the identity, sequence and stack quality of the sorted mail, aiding efficient refeeding.

The storage rack of the present invention provides for better ergonomics and workflow when transferring mail. The present invention provides methods for overcoming the problems of the prior art and efficiently sorting incoming or outgoing mailpieces. While the present invention has been disclosed and described with reference to a single embodiment thereof, it will be apparent, as noted above that variations and modifications may be made therein. It is also noted that the present invention is not limited to mailpiece sorting. It is, thus, intended in the following claims to cover each variation and modification that falls within the true spirit and scope of the present invention.

What is claimed is:

1. A rack for storing sorted mailpieces that have been sorted by an automated mail sorting apparatus comprising:

a plurality of shelves each comprising an upper end and a lower end and configured to accept and store mail containers;

a shelf extension projecting from the lower end of at least one shelf of the plurality of shelves for holding at least one of the mail containers at a compound angle, each shelf extension comprising at least one rest for holding one of the mail containers for facilitating access by an operator;

the compound angle comprising the angle of the extension to the horizontal axis of between greater than about 0 degrees and not more than about 50 degrees and an angle of the rest with respect to a front edge of the rack of between greater than about 0 degrees and less than about 90 degrees.

2. The rack as claimed in claim 1 further comprising:

a ridge secured at the lower end of at least one of the plurality of shelves to keep a forward most mail container on the shelf from sliding onto the extension.

3. The rack as claimed in claim 1 wherein the plurality of shelves further comprises at least a portion that has an anti-friction configuration.

4. The rack as claimed in claim 3 wherein the anti-friction configuration is Delrin® brand acetal polymer resin.

5. The rack as claimed in claim 3 wherein the anti-friction configuration comprises a ball bearing mechanism.

6. The rack as claimed in claim 1 wherein the plurality of shelves comprises a top, middle and lower shelf, the top shelf positioned at an angle of about 13 degrees to horizontal, the middle shelf positioned at an angle in the range of about between 10 and 15 degrees to horizontal and the lower shelf is positioned at an angle of about 13 degrees to horizontal.

7. The rack as claimed in claim 6 wherein the shelf extension projecting from the lower end of the upper shelf is at an angle of about 50 degrees to horizontal.

8. The rack as claimed in claim 7 wherein the shelf extension projecting from the lower end of the middle shelf is at an angle of about 30 degrees to horizontal.

9. The rack as claimed in claim 8 wherein the shelf extension for the top shelf projects from the top shelf at a first horizontal distance and the shelf extension for the middle shelf projects from the middle shelf at second horizontal distance which is greater than the first horizontal distance.

10. The rack as claimed in claim 1 further comprising adjustable feet for the rack height.

* * * * *